US010710754B2

(12) United States Patent
Sassi

(10) Patent No.: US 10,710,754 B2
(45) Date of Patent: Jul. 14, 2020

(54) MACHINE FOR FORMING AND FILLING BOX-LIKE BODIES OF DIFFERENT TYPES

(71) Applicant: GIMA S.P.A., Zola Predosa (IT)

(72) Inventor: Fabio Sassi, Zola Predosa (IT)

(73) Assignee: I.M.A. INDUSTRIA MACCHINE AUTOMATICHE S.P.A., Bologna (IT)

( * ) Notice: Subject to any disclaimer, the term of this patent is extended or adjusted under 35 U.S.C. 154(b) by 166 days.

(21) Appl. No.: 15/762,984

(22) PCT Filed: Oct. 6, 2016

(86) PCT No.: PCT/EP2016/073915
§ 371 (c)(1),
(2) Date: Mar. 23, 2018

(87) PCT Pub. No.: WO2017/060376
PCT Pub. Date: Apr. 13, 2017

(65) Prior Publication Data

US 2019/0084701 A1 Mar. 21, 2019

(30) Foreign Application Priority Data

Oct. 8, 2015 (IT) ..... 102015000059428

(51) Int. Cl.
*B65B 5/02* (2006.01)
*B65B 35/24* (2006.01)
(Continued)

(52) U.S. Cl.
CPC ..... *B65B 5/024* (2013.01); *B65B 5/06* (2013.01); *B65B 35/24* (2013.01); *B65B 35/405* (2013.01);
(Continued)

(58) Field of Classification Search
CPC ..... B65B 35/38; B65B 35/405; B65B 35/24; B65B 5/06; B65B 5/024; B65B 2210/02;
(Continued)

(56) References Cited

U.S. PATENT DOCUMENTS 3,956,976 A * 5/1976 Vogel ..... B65B 43/185 493/315
4,061,081 A * 12/1977 Pinto ..... B65B 43/185 493/317
(Continued)

FOREIGN PATENT DOCUMENTS

DE 2613155 A1 * 9/1977 ..... B65B 35/40
EP 1106512 A1 6/2001
(Continued)

OTHER PUBLICATIONS

International Search Report dated Dec. 23, 2016 re: Application No. PCT/EP2016/073915, pp. 1-4, citing: U.S. Pat. No. 5,456,058 A, EP 2 829 483 A1, WO 97/46374 A1, EP 1 106 512 A1 and JP 2005 119731 A.
(Continued)

*Primary Examiner* — Thanh K Truong
*Assistant Examiner* — Thomas M Wittenschlaeger
(74) *Attorney, Agent, or Firm* — Cantor Colburn LLP

(57) ABSTRACT

A machine for forming and filling box-like bodies of different types having a magazine for sheets to be subjected to forming, at least one handling element for at least one sheet at a time, and a conveyor belt for products, clustered in bundles constituted by at least one product each. The machine includes a station for picking up and delivering shaped sheets, in which the magazine accommodates aligned and juxtaposed sheets and at least one handling element having an end bracket provided with at least one grip element and at least one assembly with arms which are
(Continued)

articulated with respect to the bracket and are independently movable with respect to a fixed-frame.

9 Claims, 8 Drawing Sheets

(51) Int. Cl.
*B65B 43/18* (2006.01)
*B65B 43/52* (2006.01)
*B65B 5/06* (2006.01)
*B65B 59/00* (2006.01)
*B65B 35/40* (2006.01)

(52) U.S. Cl.
CPC ..... *B65B 43/185* (2013.01); *B65B 43/52* (2013.01); *B65B 59/00* (2013.01); *B65B 2210/02* (2013.01)

(58) Field of Classification Search
CPC ..... B65B 59/00; B65B 43/185; B65B 43/52; B65G 15/42; B65G 15/12; B65G 17/08; B65G 41/001; B65G 41/003
USPC ..... 198/626.3, 626.4, 867.08, 867.11, 803.4, 198/803.11, 809, 845, 844.1, 601
See application file for complete search history.

(56) References Cited

U.S. PATENT DOCUMENTS 4,893,707 A * 1/1990 Langen ..... B65G 17/26 198/626.3
4,976,582 A * 12/1990 Clavel ..... B25J 9/1065 108/138
5,456,058 A * 10/1995 Ziegler ..... B65B 5/106 53/447
5,531,661 A * 7/1996 Moncrief ..... B65B 43/265 493/313
5,782,734 A * 7/1998 Reuteler ..... B65B 43/305 493/123
5,806,289 A * 9/1998 Sassi ..... B65B 19/24 493/163
5,928,123 A * 7/1999 Davis, Jr. ..... B31B 50/00 493/313
6,659,928 B2 * 12/2003 Baumeister ..... B65H 3/42 414/737
6,804,931 B2 * 10/2004 Pike ..... B65B 35/40 53/252
6,811,024 B2 * 11/2004 Wieduwilt ..... B65B 43/52 198/803.13
6,872,176 B2 * 3/2005 Wyss ..... B65B 43/285 493/123
7,644,558 B1 * 1/2010 Fallas ..... B25J 9/0093 53/251
8,096,410 B2 * 1/2012 Kalm ..... B65G 15/12 198/840
8,671,651 B2 * 3/2014 Poutot ..... B65B 5/024 53/398
8,776,984 B2 * 7/2014 Monti ..... B65B 35/38 198/432
8,986,183 B2 * 3/2015 Monti ..... B65B 43/185 493/162
8,997,438 B1 * 4/2015 Fallas ..... B65G 47/914 414/222.01
9,376,269 B2 * 6/2016 Rodi ..... B65G 47/34
9,713,911 B2 * 7/2017 Cavazza ..... B65B 43/265
9,796,495 B2 * 10/2017 Boden ..... B25J 15/0616
10,221,020 B2 * 3/2019 Menke ..... B65G 47/66
2009/0205929 A1 * 8/2009 DeGuglielmo ..... B65B 5/024 198/347.1
2011/0173930 A1 * 7/2011 Poutot ..... B65B 35/36 53/473
2012/0031737 A1 * 2/2012 Felk ..... B65B 43/52 198/604
2016/0068290 A1 * 3/2016 Bonnain ..... B65B 35/24 53/168

FOREIGN PATENT DOCUMENTS

EP 2829483 A1 1/2015
JP 2005119731 A 5/2005
WO 9746374 A1 12/1997

OTHER PUBLICATIONS

Written Opinion dated Dec. 23, 2016 re: Application No. PCT/EP2016/073915, pp. 1-7, citing: U.S. Pat. No. 5,456,058 A, EP 2 829 483 A1, WO 97/46374 A1 and EP 1 106 512 A1.

* cited by examiner

MACHINE FOR FORMING AND FILLING BOX-LIKE BODIES OF DIFFERENT TYPES

TECHNICAL FIELD

The present disclosure relates to a machine for forming and filling box-like bodies of different types.

BACKGROUND

In particular the use is known of two different types of shaped sheets (blanks) for providing box-like bodies that are generally parallelepiped in shape.

In some cases shaped sheets are used (which are cut according to a preset shape, generally by way of a punching process), which, following adapted folding and gluing operations, take on the desired box-like shape structure. In this case the shaped sheets are generally referred to as "flat sheets".

In other cases the shaped sheets, which define the blank to be folded further in order to provide the box-like body, have already been subjected to a first operation of folding and gluing. This second type of shaped sheets, referred to as "pre-glued", has a tubular shape structure and, for storage, is collapsed with respect to two mutually opposite edges.

Both types of shaped sheets ("flat sheets" and "pre-glued sheets") offer numerous mutually competing advantages and therefore makers of machines for packaging have developed several models for operating solely with one type or the other.

The huge difference in encumbrances of "flat sheets" with respect to "pre-glued sheets" in fact determines the need to adopt very different implementation architectures for the stations designed for the pickup and delivery of the sheets, which translate to different elements for movement; the same needs are encountered for the lines for conveying and forming the different types of sheets, which translate to different movement elements, and also for the stations for inserting products into the different types of sheets, which translate to different elements for manipulating the products and/or bundles constituted by a preset plurality of products.

SUMMARY

The aim of the present disclosure is to solve the above mentioned drawbacks, by providing a machine for forming and filling box-like bodies of different types, which in particular is adapted to operate interchangeably on "flat sheets" and on "pre-glued sheets".

Within this aim, the disclosure provides a machine for forming and filling box-like bodies of different types which has a simple structure and shape.

The disclosure provides a machine for forming and filling box-like bodies of different types which adopts universal movement means.

The disclosure also provides a machine for forming and filling box-like bodies of different types which is adapted to convey and form box-like bodies starting equally from flat sheets and/or from pre-glued sheets.

The disclosure further provides a machine for forming and filling box-like bodies of different types which is adapted to ensure a precise positioning of any type of sheet during the steps for conveying and forming them.

The disclosure also provides a machine for forming and filling box-like bodies of different types which is adapted to operate with continuous motion and with alternating motion.

The disclosure provides a machine for forming and filling box-like bodies of different types which makes it possible to insert them equally from the front and from above.

The disclosure further provides a machine for forming and filling box-like bodies of different types which requires a few simple change-of-format operations in order to pass from the configuration adapted to insert the products into a first type of box-like bodies to the configuration adapted to insert the products into a second type of box-like bodies.

The disclosure provides a machine for forming and filling box-like bodies of different types which is adapted to operate in association with a conveyance line of the box-like bodies which is actuated interchangeably with continuous motion and/or with alternating motion.

The disclosure also provides a machine for forming and filling box-like bodies of different types which has a different structure with respect to conventional machines.

The present disclosure further provides a machine for forming and filling box-like bodies of different types which is low cost, easily and practically implemented and safe in use.

This aim and these and other advantages which will become better apparent hereinafter are achieved by providing a machine for forming and filling box-like bodies of different types, of the type comprising a magazine for sheets to be subjected to forming, at least one handling element for at least one sheet at a time, and a conveyor belt for products, clustered in bundles constituted by at least one product each, characterized in that it comprises:

- a station for picking up and delivering shaped sheets, in which said magazine accommodates a plurality of aligned and juxtaposed sheets and said at least one handling element comprises an end bracket provided with at least one grip means and at least one assembly with arms which are articulated with respect to said bracket and are independently movable with respect to a fixed frame;
- a line for conveying and forming box-like bodies, which is constituted by at least one suction belt closed in a loop and arranged at least in its initial portion, at least one strap closed in a loop and provided with a plurality of protruding teeth, which is parallel to said suction belt, is arranged at least in the end portion of said line, and has the initial front substantially juxtaposed with respect to the end portion of said suction belt, and at least one band closed in a loop and provided with a plurality of protruding tabs;
- a movement apparatus for a bar provided with at least one functional unit that abuts against at least one respective bundle, said bar being movable according to at least two degrees of freedom, by way of the action of said movement apparatus.

BRIEF DESCRIPTION OF THE DRAWINGS

Further characteristics and advantages of the disclosure will become better apparent from the detailed description that follows of a preferred, but not exclusive, embodiment of the machine for forming and filling box-like bodies of different types according to the disclosure, which is illustrated by way of non-limiting example in the accompanying drawings, in which.

DETAILED DESCRIPTION OF THE DRAWINGS

Figure 1:
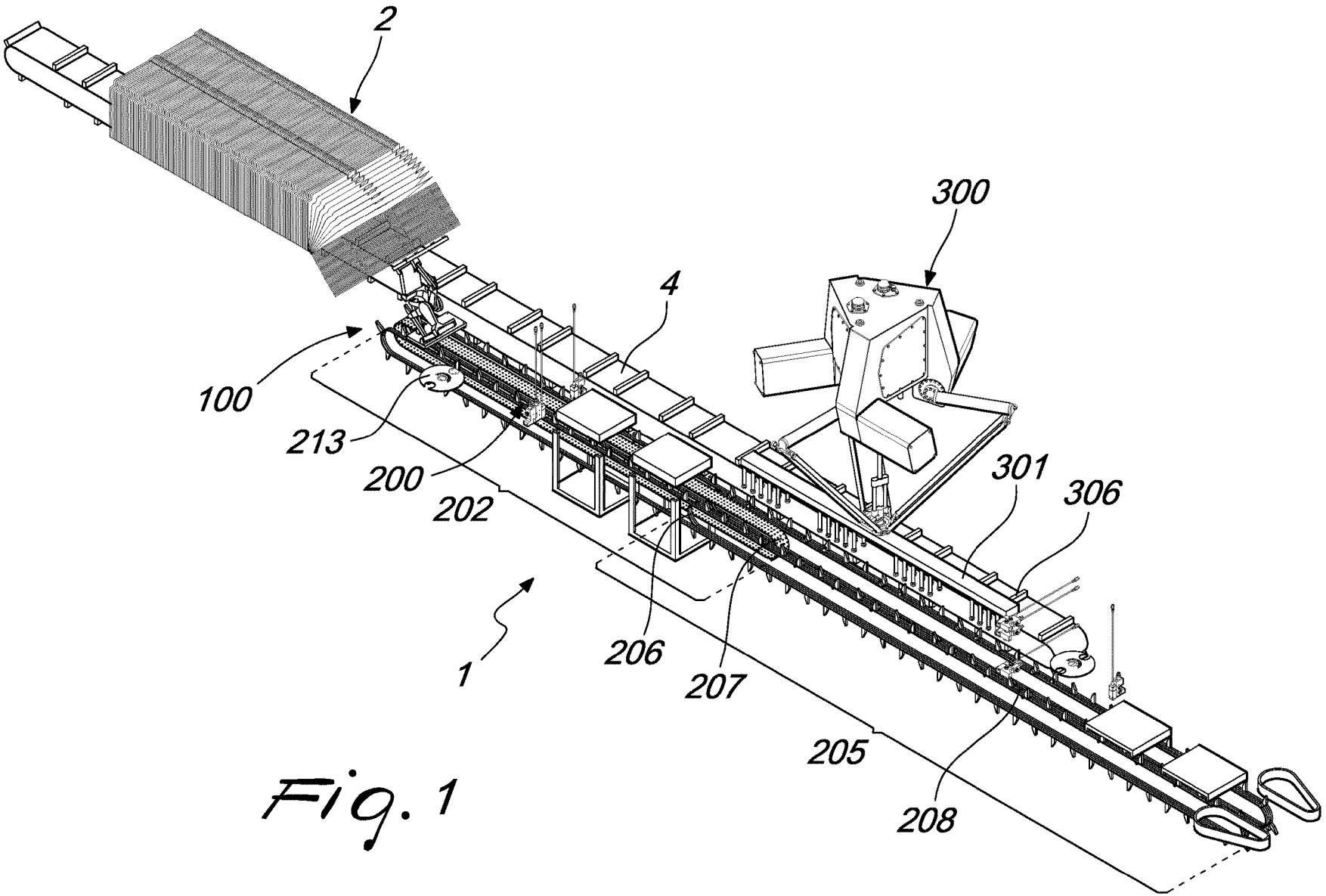
FIG. 1 is a perspective view of a machine for forming and filling box-like bodies of different types according to the disclosure.
Figure 2:
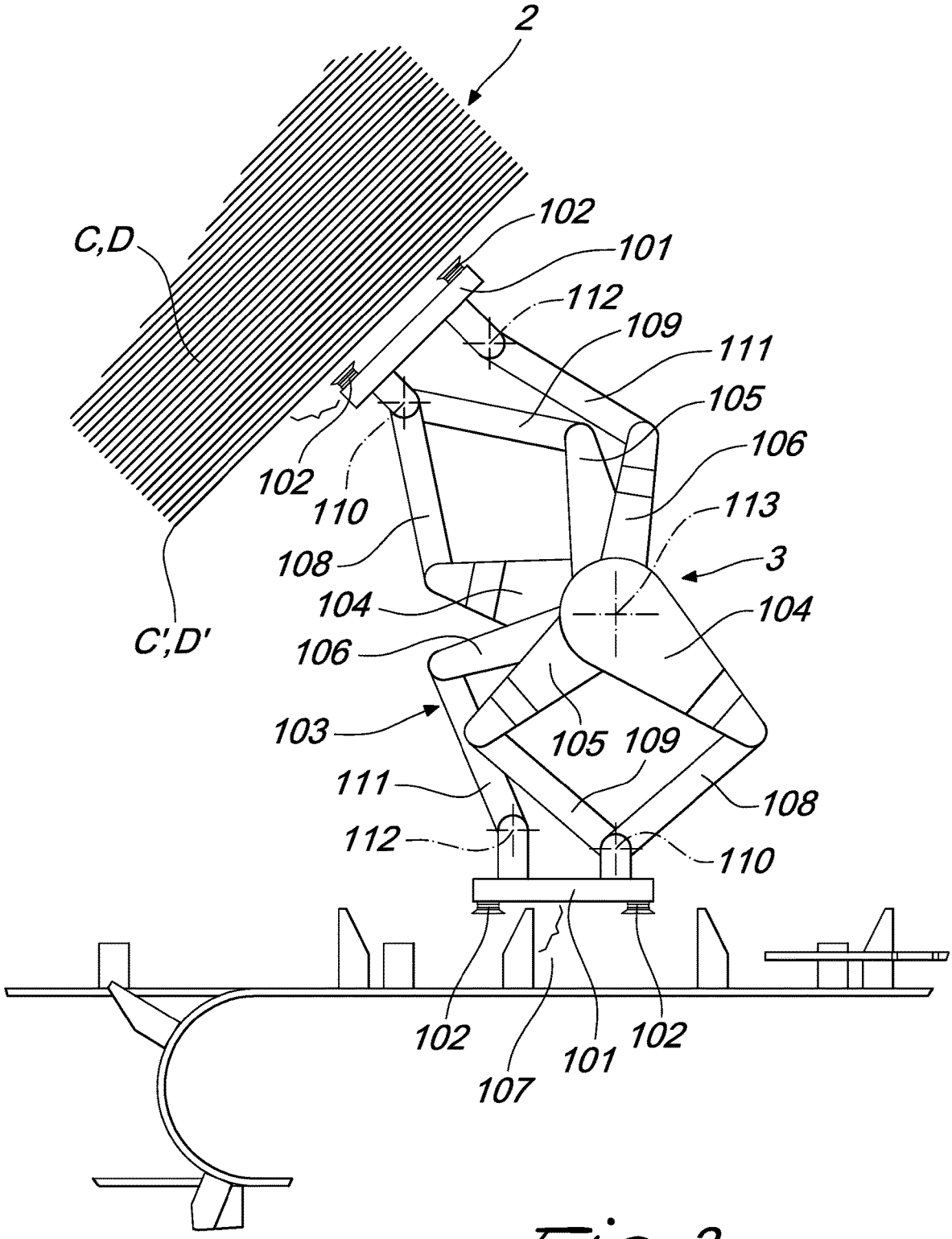
FIG. 2 is a front elevation view of an enlarged detail of the machine of FIG. 1.
Figure 3:
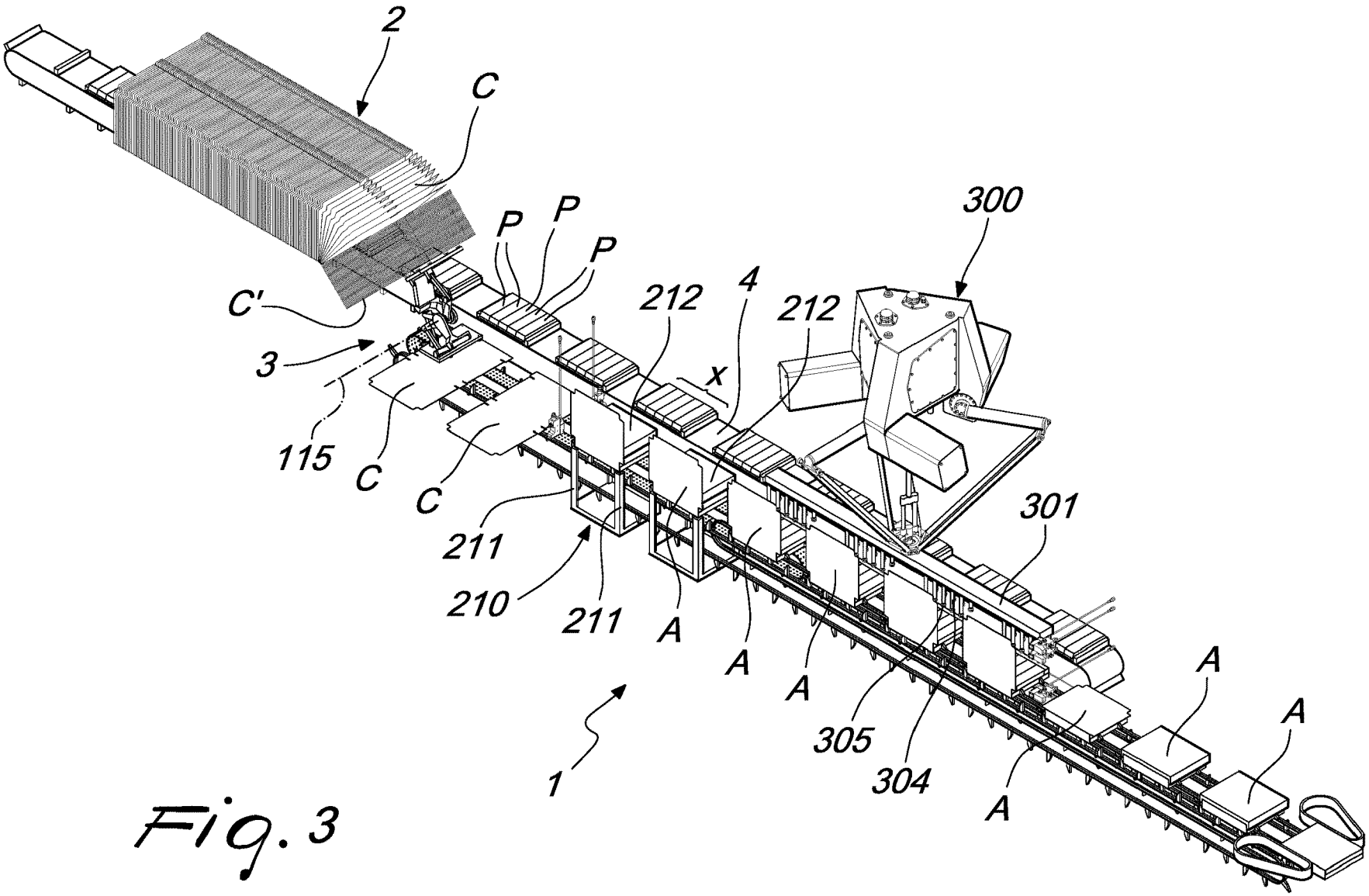
FIG. 3 is a perspective view of the machine of FIG. 1, in the act of forming and filling a first type of box-like body.
Figure 4:
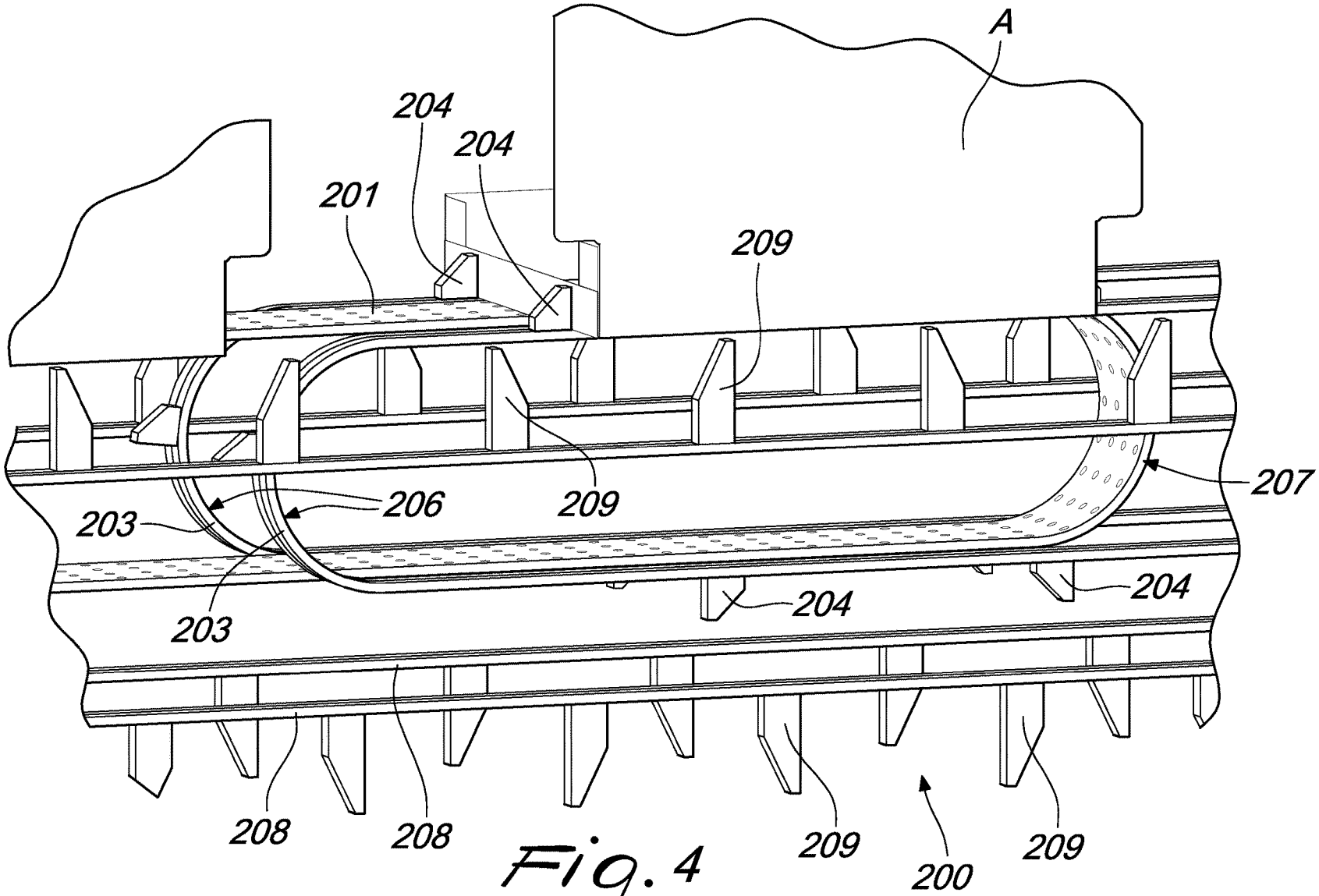
FIG. 4 is a perspective view of an enlarged detail of FIG. 3.
Figure 5:
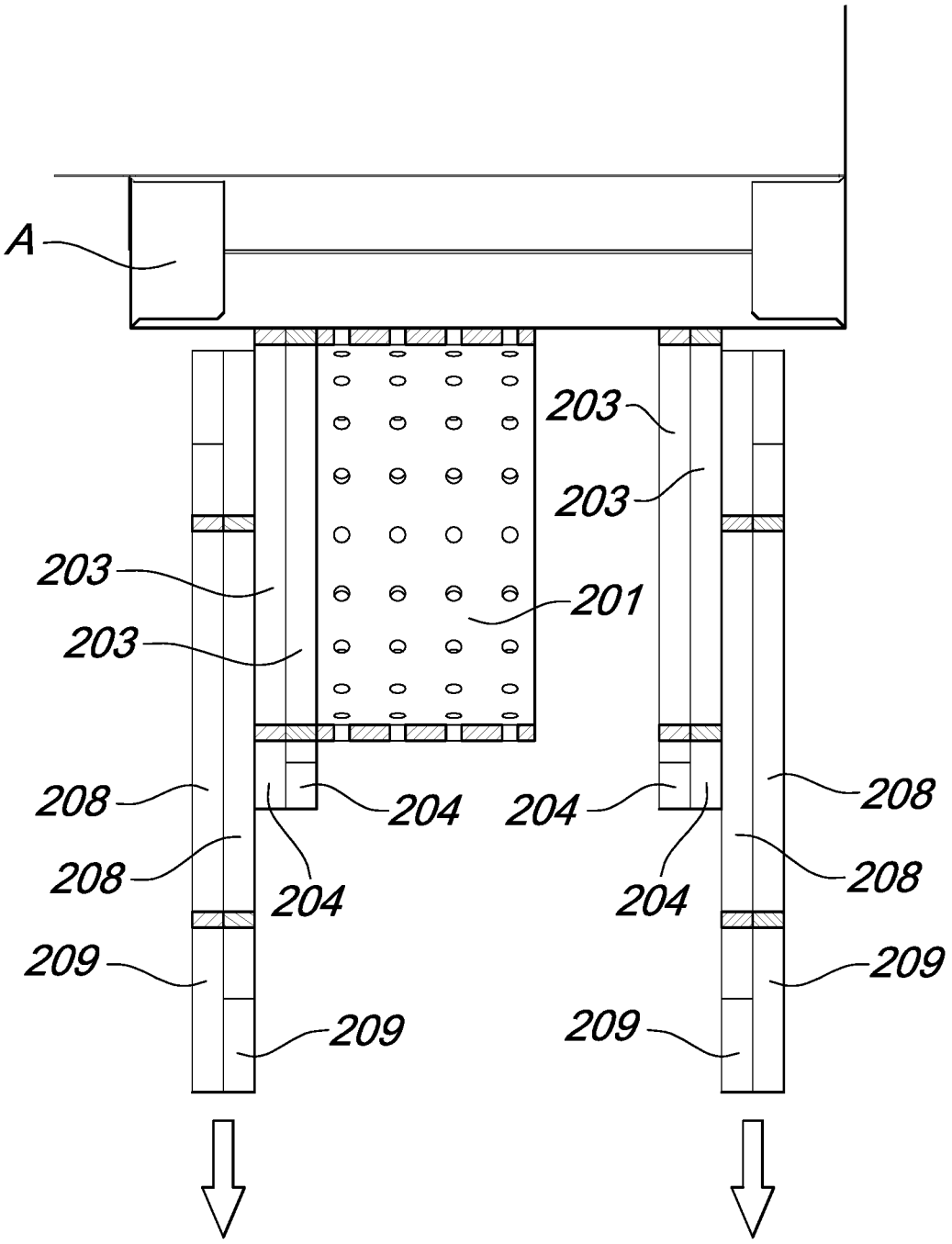
FIG. 5 is a partially cross-sectional front elevation view of an enlarged detail of FIG. 4.
Figure 6:
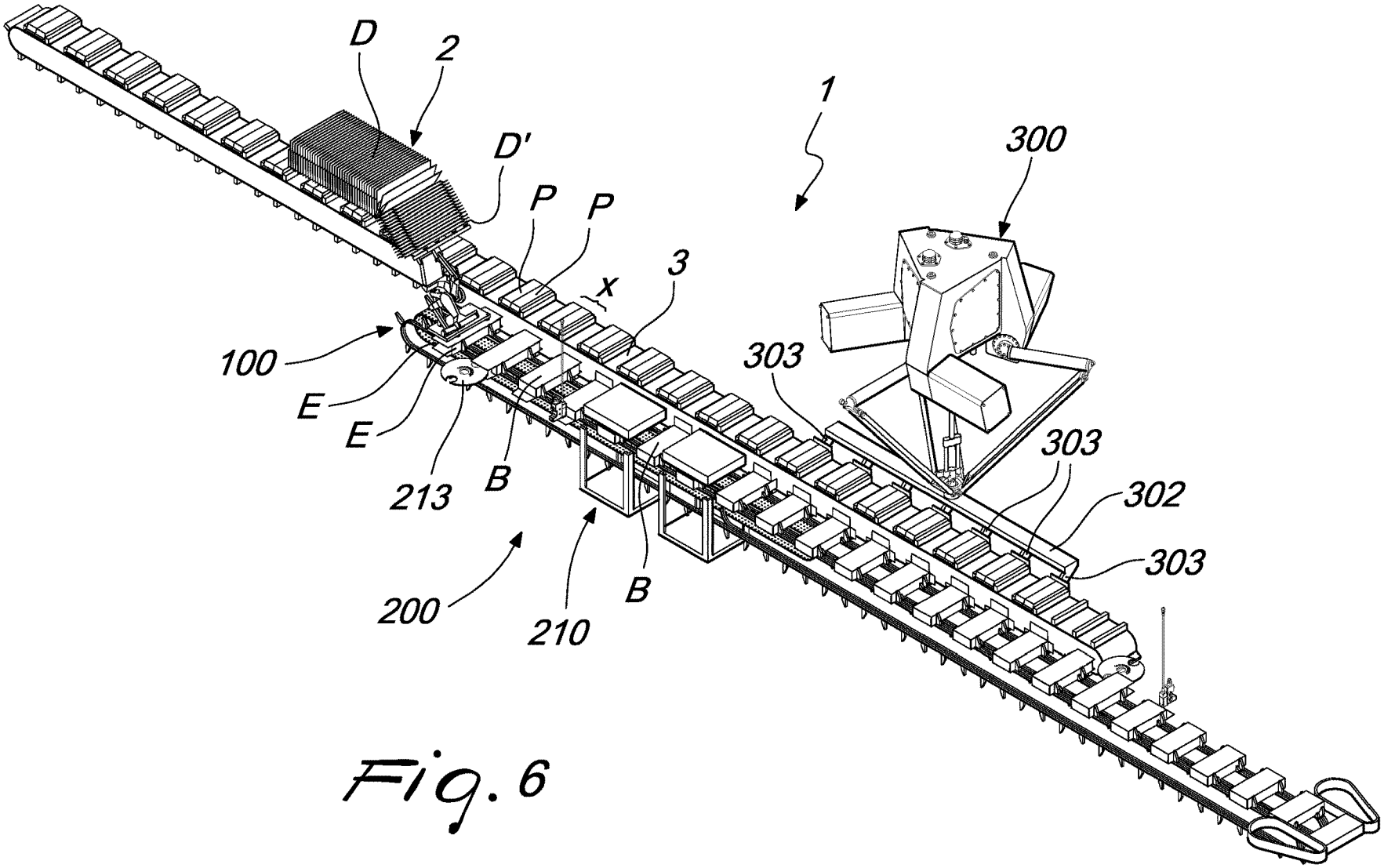
FIG. 6 is a perspective view of the machine of FIG. 1, in the act of forming and filling a first type of box-like body.
Figure 7:
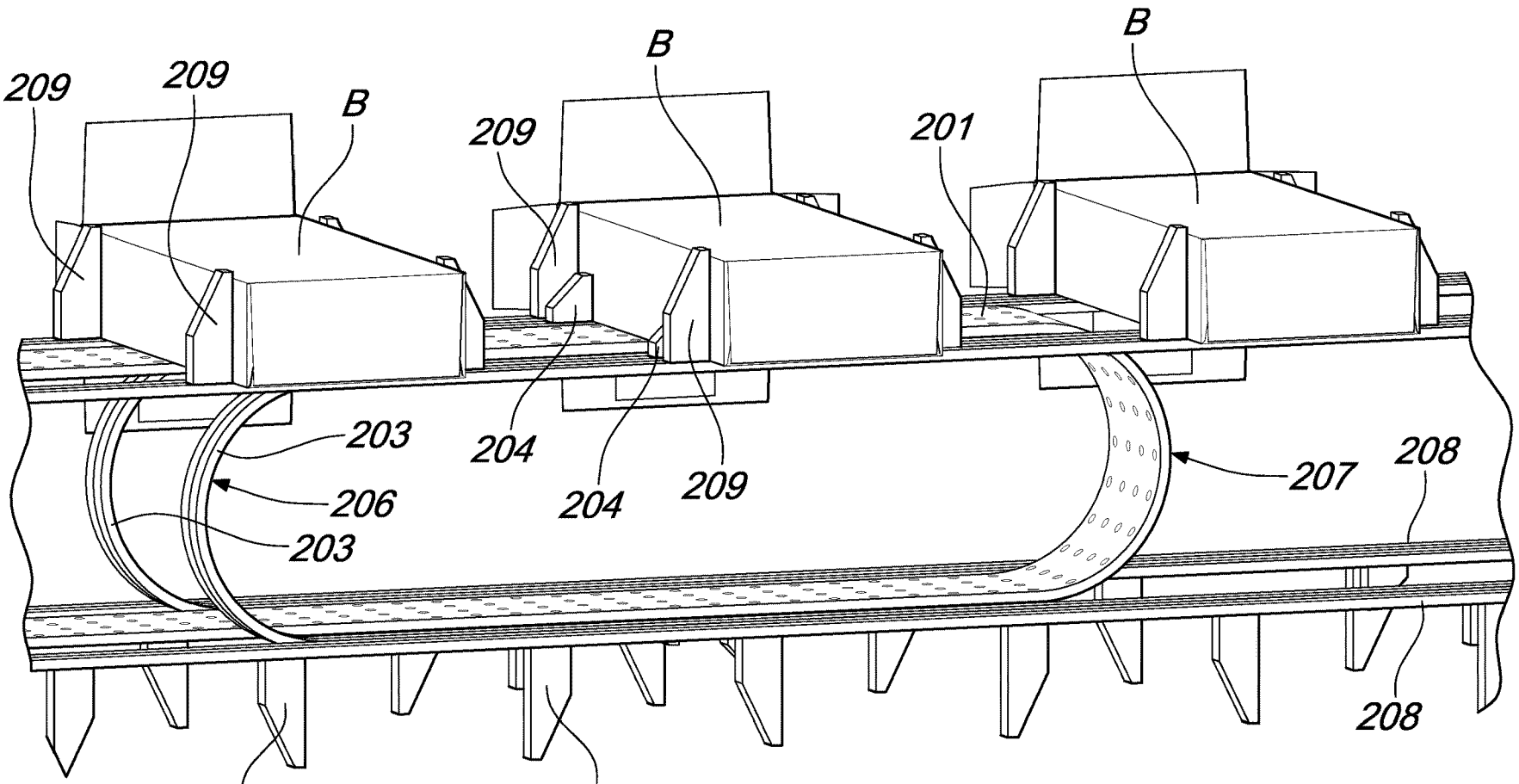
FIG. 7 is a perspective view of an enlarged detail of FIG. 6.
Figure 8:
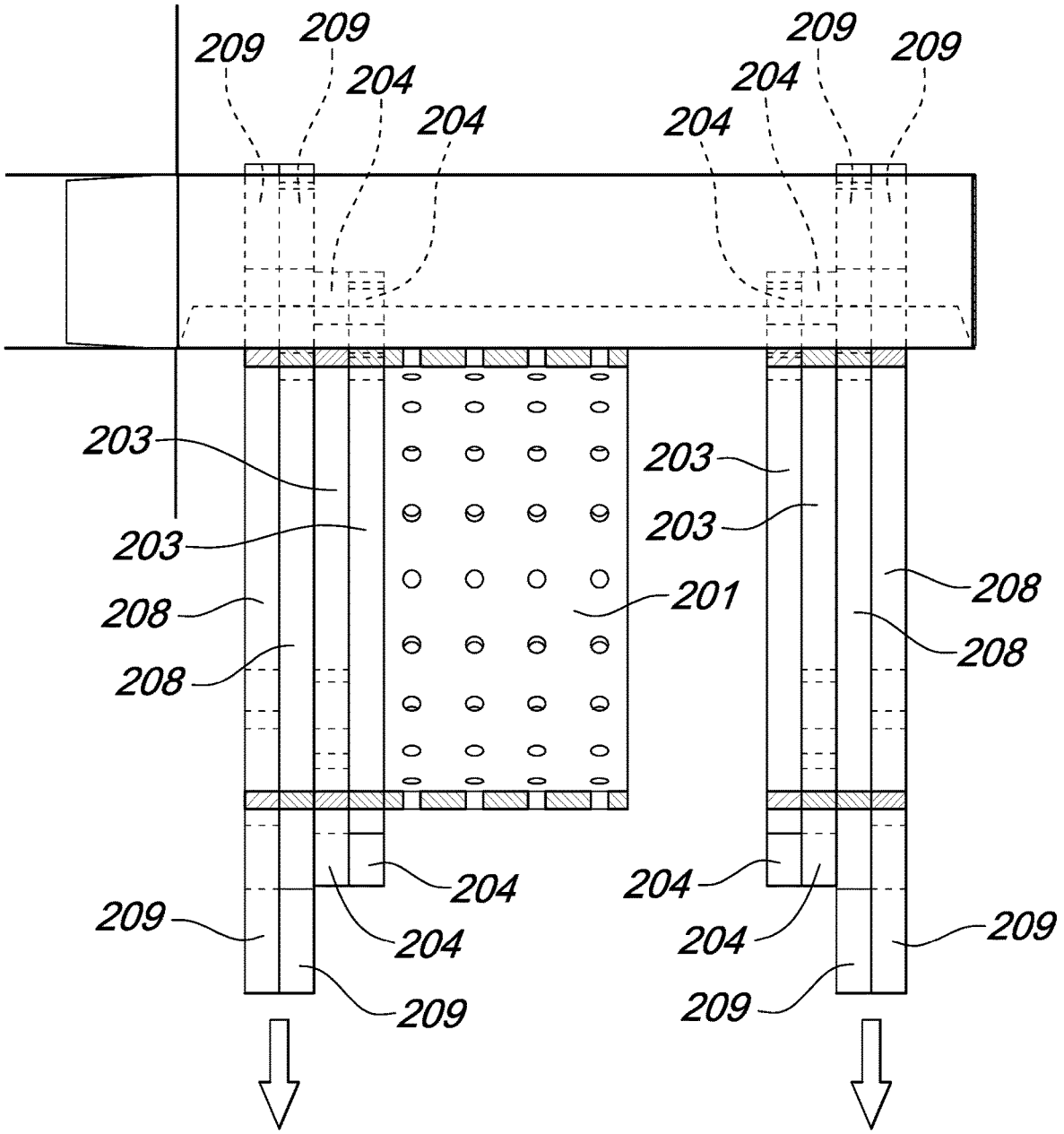
FIG. 8 is a partially cross-sectional front elevation view of an enlarged detail of FIG. 7.

With reference to FIGS. 1-8, the reference numeral 1 generally designates a machine for forming and filling box-like bodies A, B of different types.

The machine 1 comprises a magazine 2 for sheets A, B to be subjected to forming, at least one handling element 3 for at least one sheet A, B at a time, and a conveyor belt 4 for products P, clustered in bundles X constituted by at least one product P each.

According to the disclosure, the machine 1 comprises a station 100 for picking up and delivering shaped sheets C, D, in which the magazine accommodates a plurality of aligned and juxtaposed sheets C, D and the at least one handling element 3 comprises an end bracket 101 provided with at least one grip means 102 and at least one assembly 103 with arms 104, 105, 106 which are articulated with respect to the bracket 101 and are independently movable with respect to a fixed frame.

The machine 1 according to the disclosure further comprises a line 200 for conveying and forming box-like bodies A, B, which is constituted by at least one suction belt 201 closed in a loop and arranged at least in its initial portion 202, at least one strap 203 closed in a loop and provided with a plurality of protruding teeth 204, which is parallel to the suction belt 201, is arranged at least in the end portion 205 of the line 200, and has the initial front 206 substantially juxtaposed with respect to the end portion 207 of the suction belt 201.

The line 200 is furthermore constituted by at least one band 208 closed in a loop and provided with a plurality of protruding tabs 209.

The machine 1 according to the disclosure further comprises a movement apparatus 300 for a bar 301, 302, the latter being provided with at least one functional unit that abuts against at least one respective bundle X.

The bar 301, 302 can move, by way of the action of specific actuators provided in the movement apparatus 300, preferably along two separate directions: the bar 301, 302 can in fact be translated transversely with respect to the belt 3 and to the line 200, in particular the bar 301, 302 can move from the line 200 toward the belt 3 and vice versa; the bar 301, 302, furthermore, can translate at right angles with respect to the belt 3 and to the line 200, in particular the bar 301, 302 can move along a direction away from/towards them (thus varying, with particular reference to the example shown in the accompanying figures, its height).

With particular reference to an embodiment of undoubted applicative interest, the bracket 101 is controlled by a respective actuation system for its movement between a first configuration of alignment with the end sheet C', D' accommodated in the magazine 2, in the condition where the at least one grip means 102 is in contact with the end sheet C', D', and a second configuration of alignment with a conveyance line 200 of the sheets C, D which corresponds to a delivery region 107 of the sheets C, D that are to be subjected to the forming process (the possibility is not ruled out that during the transfer the sheets can undergo some preparatory steps of the forming process that will turn them into box-like bodies A, B).

It should be noted that the arms 104, 105 and 106, which are independently movable with respect to the fixed frame of the station 100, are three in number.

The first two arms 104, 105 are pivoted to respective rods 108, 109, both having the end pivoted to the bracket 101 according to a same first rotation axis 110, a third arm 106 being pivoted to a rod 111 the free end of which is engaged rotatably with the bracket 101 with respect to a second rotation axis 112.

In practice, by way of relative movements of each arm 104, 105 and 106, it is possible to move and orientate the bracket 101 according to three separate degrees of freedom, allowing the movement of sheets C, D of any size (according to the dimensions of the sheet C, D handled, the path followed by the bracket 101 in order to pass from the first to the second configuration will change in each instance).

It is useful to point out that, according to an embodiment of undoubted applicative interest, the at least one grip means 102 is of the suction type, of the type preferably chosen from among a sucker, a belt with suction holes, and the like.

This embodiment is particularly efficient since it makes it possible to activate and deactivate the suction according to the operating step, thus facilitating the operations to hold and release the sheet C, D and ensuring the stability thereof during the transfer from the magazine 2 to the delivery region 107.

In order to increase the speed of the station 100 and, as a consequence, the efficiency of the machine 1 within which it is integrated, the assemblies 103 with articulated arms 104, 105 and 106 are at least two in number, mutually offset by at least one predefined angle (more precisely, such angle is variable during the operation of the station 100 according to a preset law of motion).

With particular reference to the embodiment shown in the accompanying figures, it should be noted that the two assemblies 103 can be offset with respect to each other by an angle comprised between 150° to 180° (clockwise or anti-clockwise), although the possibility is not excluded of using other angular offsets.

It should be noted that, with particular reference to an embodiment of undoubted applicative interest (to which the accompanying figures refer), the at least two assemblies 103 are mutually coaxial, each arm 104, 105 and 106 of each assembly 103 therefore will be rotatable, by way of the action of a respective motor device, with respect to a single common rotation axis 113.

According to an alternative embodiment that is equally advantageous in terms of implementation, the at least two assemblies 103 are mounted on a rotatable carousel.

In such embodiment each arm 104, 105 and 106 of each assembly 103 will be rotatably pivoted, by way of the action of a respective motor apparatus, according to a specific axis, to the surface of the carousel, which in turn can rotate with respect to a central axis thereof.

In this second embodiment the arms 104, 105 and 106 therefore will protrude from the outline of the carousel and their rotations will determine corresponding movements of the bracket 101 with respect to the carousel. The carousel can furthermore rotate with respect to its central axis so as to define all the movements of the bracket 101 that are integral with the carousel.

In any case it should be noted that each motor apparatus and each motor device, i.e. all the components used to move the arms 104, 105 and 106 with respect to the respective pivoting axes, are of the type preferably chosen from among controlled electric motors, controlled brushless motors, actuation systems constituted by motors and camshafts and the like.

What is essential to note is that each arm 104, 105 and 106 can move independently of the others, so as to generate the desired law of motion for the bracket 101 by way of a specific combination of the simultaneous and independent movements of the arms 104, 105 and 106.

The station 100, in a particularly efficient embodiment thereof, comprises, along the path defined between the first and the second configuration of the bracket 101, a contrast element for forming/opening out a pre-glued sheet D picked up from the magazine 2 by the bracket 101 (by way of the opening-out, the pre-glued sheet D will assume a prismatic configuration, while remaining open onto two mutually opposite faces, which constitute the bottom and the top of the box-like body B).

The contrast element could be constituted by at least one sucker, arranged along the path of the sheet D while the bracket 101 is transferring it from the first to the second configuration: the suction circuit associated with the sucker can be activated upon the transition of the sheet D in order to produce the adhesion of the sucker to one of the surfaces of the sheet D. The advancement of the bracket 101 toward the second configuration, while the sucker of the contrast element is still attached to the face of the sheet D, will determine a distancing of the face of the sheet D attached to the sucker with respect to the face of the sheet D attached to the at least one grip means 102 of the bracket 101: this corresponding movement will ensure the transition from the squashed and substantially planar arrangement of the sheet D to a substantially tubular arrangement (with prismatic volume), corresponding to a box-like body B open onto two mutually opposite fronts.

The possibility is not ruled out of using, instead of the sucker in the contrast element, movable tabs that can be arranged so as to interfere with the advancing sheet D transported by the bracket 101: in this case too, relative movement can determine a shaping of the sheet D.

According to an alternative and equally advantageous embodiment, the station 100 can comprise, at the delivery region 107, an abutment element for forming/opening out the sheet D.

In this case too, upon the approach of the bracket 101 which supports the pre-glued sheet D toward the delivery region 107, at least one portion of the sheet D will rest against the abutment element with consequent forming/opening out of the sheet D as a result of the different speed of the bracket 101 with respect to the abutment element.

With particular reference to a specific embodiment that is simple to implement and efficacious in operation, the band 208 closed in a loop is controlled by a respective actuation system for its movement between a first level of alignment of its upper face with the upper face of the at least one suction belt 201 and of the at least one strap 203, and a second level, which is separated from the upper face of the at least one suction belt 201 and of the at least one strap 203 by a distance at least equal to the height of the protruding tabs 209.

The purpose of the band 208 is to convey pre-glued sheets D, while retaining them (in a partially formed configuration, i.e. in a form corresponding to the shape structure of the box-like body B, but open onto at least one of its faces), between two successive protruding tabs 209.

The fact that the at least one band 208 can change its height makes it possible to have a line 200 in which the tabs 209 for the entrainment of the box-like bodies B can be present (in order to convey the box-like bodies B), or absent, in the latter case leaving the task of entraining the sheets C and the box-like bodies A (obtained by forming the sheets C) to the suction belt 201 and to the strap 203.

It is useful to point out that the at least one suction belt 201 will comprise a plurality of suction holes for locking in place a flat sheet C to be subjected to forming.

The spacing between the protruding teeth 204 of each strap 203 closed in a loop will preferably be greater than the width of the at least partially formed box-like body A to be conveyed.

In this manner the box-like body A will be retained between consecutive teeth 204 and therefore no slippages can happen upstream or downstream with respect to its position in the line 200, since it will be retained between teeth 204 that precede it and follow it.

In order to ensure the stable and secure conveyance of the box-like bodies A, the straps 203 closed in loops are at least two in number: at least one first strap 203 will be provided with first protruding teeth 204 designed to abut against the start face of a respective at least partially formed box-like body A to be conveyed, and at least one second strap 203 will be provided with second protruding teeth 204 designed to abut against the end face of the at least partially formed box-like body A.

In this manner the box-like body A will be interposed between mutually opposite teeth 204 which will delimit it, eliminating the risk of its sliding motions, forward or rearward, thus ensuring that its position is always and constantly defined with precision.

Such characteristic is very important both in continuous operation (the line 200 is constantly in motion and the box-like bodies A advance on it without ever stopping), and in alternating operation (the line 200 is periodically temporarily stopped and the box-like bodies A stop in order to undergo specific processing).

Even more specifically, the straps 203 closed in loops are four in number: in fact there will be two first, outer straps 203 (provided with teeth 204 designed to abut against the start faces of a respective box-like body A) and two second, inner straps 203 (provided with teeth 204 designed to abut against the end faces of a respective box-like body A).

In this manner the box-like body A will be locked in place with two teeth 204 on its mutually opposite start and end faces, and any accidental rotation thereof will also be prevented.

It should conveniently be noted that the spacing between the consecutive and corresponding protruding tabs 209 of a same band 208 closed in a loop is greater than the width of the at least partially formed box-like body B to be conveyed. In this manner the box-like body B can be interposed between them and locked in place thereat in order to prevent its sliding motions (forward or rearward) and/or accidental rotations. Preferably the spacing between consecutive tabs 209 will have to be slightly larger than the width of the box-like body B in order to be able to accommodate it substantially without play (and therefore locking it in place precisely and efficaciously).

According to an embodiment of undoubted practical and applicative interest, the bands 208 closed in loops are at least two in number: at least one first band 208 will be provided with first protruding tabs 209 designed to abut against the start face of a respective at least partially formed box-like body B to be conveyed, and at least one second band 208 will be provided with second protruding tabs 209 designed to abut against the end face of the at least partially formed box-like body B.

Similarly to what is described for the straps 203, this particular arrangement of the bands 208 makes it possible to precisely control the position of the box-like body B interposed between the protruding tabs 209 of the two separate bands 208.

In this case too, therefore, it is possible to further increase the precision and stability of the locking in place of the box-like body B by adopting four separate bands 208 closed in loops: in particular there will be two first, outer bands 208 and two second, inner bands 208. As in the previous case, the adoption of four separate bands will also eliminate the risk of accidental rotations of the box-like body B during its conveyance (it will in fact be locked in place by four separate protruding tabs 209, two of them abutting against its start face and the other two against its end face).

In order to ensure the correct forming of the box-like body A, the line 200 comprises at least one station 210 for folding a sheet C.

The station 210 comprises movable tapes 211 aligned with a corresponding abutment 212: the translation of the tapes 211 toward the abutment 212, with the interposition of the sheet C, determines the at least partial wrapping of the sheet C onto the abutment 212 with consequent forming of the box-like body A.

The tapes 211 are substantially constituted by laminar angular elements that, by abutting against the sheet C, produce the folding thereof according to predefined lines, which will subsequently constitute the edges of the box-like body A proper.

It should furthermore be noted that the line 1 comprises folding means 213 of the end flaps E of the box-like bodies B.

The folding means 213 are substantially aligned with the lateral edge of the line 200.

The folding means 213 are arranged in sequence along the advancement direction of the sheets D and of the box-like bodies B along the line 200 so as to define an at least partial juxtaposition of the flaps E, with consequent forming of a closed bottom for the box-like body B.

It should be noted that the line 1 is adapted to operate continuously or m alternation.

In particular it will be possible to operate continuously for processing sheets D in order to provide box-like bodies B and in alternation for processing sheets C in order to provide box-like bodies A. The possibility is not ruled out, however, of adopting different laws of motion (for example continuous in order to provide box-like bodies A and alternating in order to provide box-like bodies B).

Finally, it should be noted that the movement apparatus 300 comprises a third degree of freedom, controlled by specific actuation systems, for the translation of the bar 301, 302 along the advancement direction of the box-like bodies A, B on the line 200 and of the bundles X on the belt 3.

The third degree of freedom and the corresponding actuation systems are adapted to allow the bar 301, 302 to follow the box-like bodies A, B in order to ensure that the operations to fill the box-like bodies A and B with the bundles X can be executed continuously.

According to an embodiment of undoubted practical and applicative interest, the functional units can be a plurality, arranged mutually side by side and distributed along the respective bar 301, 302.

More specifically, the functional unit can be constituted by a fixed tab 303 designed to abut against a face of a respective bundle X in order to impose its translation, moving it from the belt 3 to the line 200, into a respective box-like body B.

According to an alternative embodiment, safe and convenient in application, the at least one functional unit comprises at least one grip element 304 which abuts, in at least one operating configuration, against the bundle X for the locking in place thereof in practice the grip element 304 must be adapted to grip the entire bundle X in order to enable the transfer thereof (therefore also its raising from the belt 3 from which it will be taken).

It should be noted that, according to a form of execution that is simple to implement and stable in operation, the at least one grip element 304 comprises a sucker 305.

The bar 301 will therefore be movable between a first configuration of alignment with the belt 4 and juxtaposition of the at least one sucker 305 against the bundle X arranged thereon, a second raised configuration in which the at least one sucker 305 keeps the bundle X raised with respect to the line 200 and to the belt 4, and a third configuration of alignment with the line 200 and release of the bundle X, by the above mentioned at least one sucker 305, into a respective box-like body A arranged on the line 200.

In order to enable the necessary versatility of the bar 301, 302, the handling element 300 can be coupled detachably to a bar 301, 302 chosen between a first bar 302 provided with at least one functional unit constituted by at least one fixed tab 303 and a second bar 301 provided with at least one functional unit comprising at least one grip element 304.

With regard to the coupling of the handling element 300 to the bar 301, in addition to the operations necessary to its correct fixing, it may be necessary to carry out operations for wiring and/or connection of a specific suction circuit that will serve the suckers 305.

It should be noted that, in order to allow an efficacious movement of the bundle X, the belt 4 can preferably comprise distributed shoulder protrusions 306: each pair of protrusions 306 will therefore be adapted to contain and delimit a respective bundle X.

Advantageously the present disclosure solves the above mentioned problems, by providing a machine 1 for forming and filling box-like bodies A, B of different types, which in particular is adapted to operate interchangeably on "flat sheets" C and on "pre-glued sheets" D.

Conveniently, the machine 1 has a simple structure and shape.

Positively the machine 1 adopts universal movement means, which are therefore capable of processing and handling box-like bodies A and B of any type and sheets C and D for making them.

Effectively the machine 1 is adapted to convey and form box-like bodies A, B starting equally from flat sheets C and/or from pre-glued sheets D.

Conveniently the machine 1 ensures a precise positioning of any type of sheet C, D during the steps for conveying and forming them.

Advantageously the machine 1 is adapted to operate with continuous motion and with alternating motion.

Positively the machine 1 makes it possible to insert the box-like bodies equally from the front and from above.

Profitably, the machine 1 requires a few simple change-of-format operations in order to pass from the configuration adapted to insert the products P into a first type of box-like bodies A, to the configuration adapted to insert the products P into a second type of box-like bodies B.

Conveniently the machine 1 has a different structure with respect to conventional machines.

Conveniently the machine 1 is easily and practically implemented and is low cost, and this ensures its industrial application.

The disclosure, thus conceived, is susceptible of numerous modifications and variations. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The disclosures in Italian Patent Application No. 102015000059428 (UB2015A004224) from which this application claims priority are incorporated herein by reference.

The invention claimed is:

1. A machine for forming and filling boxes of different types, of a type comprising a magazine for sheets to be subjected to forming, at least one handling element for handling at least one sheet at a time, and a conveyor belt for products, clustered in bundles constituted by at least one product each, further comprising:

a station for picking up and delivering shaped sheets, in which said magazine is configured to accommodates a plurality of aligned and juxtaposed sheets and said at least one handling element comprises an end bracket provided with at least one grip means and at least one assembly with arms which are articulated with respect to said bracket and are independently movable with respect to a fixed frame;

a line for conveying and forming boxes, which is constituted by at least one suction belt closed in a loop and arranged at least in an initial portion of said line, at least one strap closed in a loop and provided with a plurality of protruding teeth, which is parallel to said suction belt, is arranged at least in an end portion of said line, and has a front substantially juxtaposed with respect to an end portion of said suction belt, and at least one band closed in a loop and provided with a plurality of protruding tabs; and a movement apparatus for a bar provided with at least one functional unit configured to abuts against at least one respective bundle, said bar being movable according to at least two degrees of freedom, by way of an action of said movement apparatus, wherein said at least one band closed in a loop is controlled by a respective actuation system for movement of said at least one band between a first level of alignment of an upper face of said at least one band with an upper face of said at least one suction belt and of the at least one strap, and a second level, in which the upper face of said at least one band is separated from the upper face of said at least one suction belt and of the at least one strap by a distance at least equal to a height of said protruding tabs.

2. The machine according to claim 1, wherein said bracket is controlled by a respective actuation system for its movement between a first configuration of alignment with an end sheet accommodated inside said magazine, in a condition where said at least one grip means is in contact with said end sheet, and a second configuration of alignment with a conveyance line of said sheets which corresponds to a delivery region.

3. The machine according to claim 2, wherein said arms which are independently movable with respect to a fixed frame are three in number, two first arms being pivotable with respect to respective linkages, both having an end pivotable with respect to said bracket according to a same first rotation axis, a third arm being pivotable with respect to a rod a free end of which is engaged rotatably with said bracket with respect to a second rotation axis.

4. The machine according to claim 3, wherein said at least one grip means is of a suction type chosen from among a sucker and a belt with suction holes.

5. The machine according to claim 1, wherein said at least one suction belt comprises a plurality of suction holes for locking in place a flat sheet to be subjected to forming.

6. The machine according to claim 1, wherein a spacing between said protruding teeth of the at least one strap closed in a loop is greater than a width of an at least partially formed box to be conveyed and a spacing between said protruding tabs of said at least one band closed in a loop is greater than the width of the at least partially formed box to be conveyed.

7. The machine according to claim 1, wherein said line comprises folding means for forming the boxes starting from the respective shaped sheets.

8. The machine according to claim 1, wherein said movement apparatus comprises a third degree of freedom, controlled by specific actuation systems, for a translation of said bar along an advancement direction of the boxes on said line and of the bundles on said conveyor belt, said third degree of freedom and the corresponding actuation systems being adapted to follow said boxes for continuous operation.

9. The machine according to claim 8, wherein said functional unit is of a type chosen between a fixed tab configured to abut against a face of at least one respective bundle in order to impose a translation of said tab on said at least one respective bundle from said conveyor belt to said line, into a respective box body, and a grip element that abuts, in at least one operating configuration, against said at least one respective bundle for its locking in place, said grip element comprising a retention sucker for said at least one respective bundle.

* * * * *